US006666518B2

(12) United States Patent
Bruschi et al.

(10) Patent No.: US 6,666,518 B2
(45) Date of Patent: Dec. 23, 2003

(54) CHAIR ADAPTED TO BE STACKED

(75) Inventors: Mario Bruschi, Bollate (IT); Diego Discacciati, East Brunswick, NJ (US)

(73) Assignee: Drake Corp., East Brunswick, NJ (US)

( * ) Notice: Subject to any disclaimer, the term of this patent is extended or adjusted under 35 U.S.C. 154(b) by 0 days.

(21) Appl. No.: 09/912,386

(22) Filed: Jul. 26, 2001

(65) Prior Publication Data

US 2002/0043865 A1 Apr. 18, 2002

(30) Foreign Application Priority Data

Oct. 3, 2000 (IT) ..... MI20000553 U

(51) Int. Cl.[7] ..... A47C 7/00; A47C 7/16
(52) U.S. Cl. ..... 297/440.14; 297/239; 297/440.18
(58) Field of Search ..... 297/440.1, 440.14, 297/440.18, 239

(56) References Cited

U.S. PATENT DOCUMENTS

| | | | | | |
|---|---|---|---|---|---|
| 882,316 | A | * | 3/1908 | Horton | 297/440.18 X |
| 3,527,498 | A | | 9/1970 | Werner | |
| 4,146,269 | A | * | 3/1979 | Beckley | 297/440.18 X |
| 4,588,227 | A | | 5/1986 | Austin | |
| 4,850,647 | A | | 7/1989 | Engel | |
| 5,088,792 | A | * | 2/1992 | Guichon | 297/239 |
| 5,762,396 | A | * | 6/1998 | Barile | 297/239 |
| 5,988,755 | A | * | 11/1999 | Fastelli et al. | 297/440.1 |

FOREIGN PATENT DOCUMENTS

| | | |
|---|---|---|
| DE | 373 510 | 4/1923 |
| GB | 898 479 | 6/1962 |
| GB | 1 278 727 | 6/1972 |
| WO | WO 01-19219 A1 | 3/2001 |

* cited by examiner

*Primary Examiner*—Anthony D. Barfield
(74) *Attorney, Agent, or Firm*—Browdy and Neimark, P.L.L.C.

(57) ABSTRACT

A chair adapted to be stacked is provided, of the type having a rear frame (2) including two rear uprights (3) and rear crosspieces (5), a front frame (7) including two front uprights (8) and front crosspieces (9), a seat (10) and lateral crossbars (11) connecting the rear uprights (3) with the front uprights (8), the chair further having shaped close-fit regions (13) formed in at least one of the frames (2, 7) to removably engage, by close fitting, an underlying chair in a stacked position and the engagement taking place by forced and elastic deformation of the frames (2, 7) at the shaped close-fit regions (13).

10 Claims, 4 Drawing Sheets

2
5
3b
4
10
10a
15
10a
5
5
3
3
12
5a
3c
11
11b
6a
14
6
11a
7
12
5
13
6
6a
8b
9a
14
6
8b
11b
13
3a
9
6
6a
6a
6b
11a
12
6
6a
6b
11
9
8
1
8a
12
8
8a 2
3b
5
4
5
3b
5
4
5
III
5
10
15
5
8b
3c
11b
11a
10a
9
3
8
3c
9
10a
8b
8a
13
11b
11a
3a
8
III
8a
13
1
3a
8a
7

CHAIR ADAPTED TO BE STACKED

FIELD OF THE INVENTION

The invention relates to a chair adapted to be stacked, of the type known on the market as "Chiavari style" chair.

This type of chair comprises a rear frame consisting of two rear uprights of a slightly arched shape, the concavity of which is turned outwardly, which are made rigid with each other by a plurality of crosspieces.

The chair also comprises a front frame of less height, in turn comprising two front uprights and crosspieces rigidly connecting the front uprights themselves. Lateral crossbars are provided for each side of the chair. A seat is engaged at the rear with an intermediate portion of the rear frame and at the front with an upper portion of the front frame.

DESCRIPTION OF THE PRIOR ART

It is known that this type of chair is particularly widespread and is supplied in great amounts from agencies renting equipment for occasional events. It is greatly used for events such as marriages and parties in general, due to its agreeable and refined appearance and to its rigidity which makes it be classified as a chair of greater importance than folding chairs, and also due to the fact that this chair, in spite of its being rigid, can be easily stacked on other similar chairs, thus greatly promoting transport and storage of same.

In order to promote stacking, the seats of these chairs are provided, at the back and angularly, with notches in which the rear uprights of each chair to be superposed can be inserted, whereas the front uprights of the overlying chair are disposed before the seat of the same underlying chair.

In spite of said advantageous stacking capability, "Chiavari style" chairs of known type have the drawback that stacks or piles of reduced sizes can only be obtained because beyond a given number of said chairs in a superposed relationship, situations of unsteadiness may be created with the risk that said piles may be undone.

Practically, in order to prevent the chairs from falling or to avoid undoing of the piles formed by the superposed chairs, stacks of reduced sizes are only made, which brings about clear negative effects on costs and transportation times in storage operations.

Another drawback results from the structure of these chairs made up of a great number of rod-like elements. This structure enables a minimum overall bulkiness when the chairs are completely disassembled into their individual elements, but makes assembling operations complicated, delicate and very difficult.

A further drawback is connected with the fact that connections between the different parts of this chair are made by gluing and/or screw threaded connecting elements. Under stress and in time, these connections may break down, in particular at the seat where the greatest efforts occur.

It should be finally pointed out that the chairs in question have the particular feature of being greatly standardized in their aesthetic appearance and therefore possible structural modifications tending to reduce or eliminate the above mentioned drawbacks must not completely alter, or at all events greatly change, the appearance of said chairs.

SUMMARY OF THE INVENTION

Under this situation, the technical task of the invention is to devise a chair adapted to be stacked, of the above described type, i.e. a "Chiavari style" chair, capable of substantially obviating the mentioned drawbacks while keeping the traditional aesthetic appearance of said chair substantially unchanged. Within the scope of said technical task, it is an important aim of the invention to devise a chair capable of forming stacks or piles of greater sizes and steadiness than those obtainable with the chairs of known type.

Another important aim of the invention is to devise a chair adapted to be stacked that while being of a minimum bulkiness when completely disassembled, is particularly strong and can be easily and quickly assembled.

The technical task mentioned and the aims specified are achieved by a chair adapted to be stacked of the type comprising: a rear frame including two rear uprights and rear crosspieces connecting said rear uprights with each other, a front frame including two front uprights and front crosspieces connecting said front uprights with each other, said front and rear uprights having lower portions defining sections designed to rest on the ground, and a seat and lateral crossbars connecting said rear uprights to said front uprights, said chair comprising shaped close-fit regions formed in at least one of said frames and adapted to removably engage, by close fitting, an underlying chair in a stacked position, said engagement taking place by forced and substantially elastic deformation of at least one of said frames at said shaped close-fit regions.

BRIEF DESCRIPTION OF THE DRAWINGS

Further features and advantages of the invention will be best clarified in the following by the detailed description of a preferred embodiment of the invention, with reference to the accompanying drawings, in which.

DESCRIPTION OF THE PREFERRED EMBODIMENT

Figure 1:
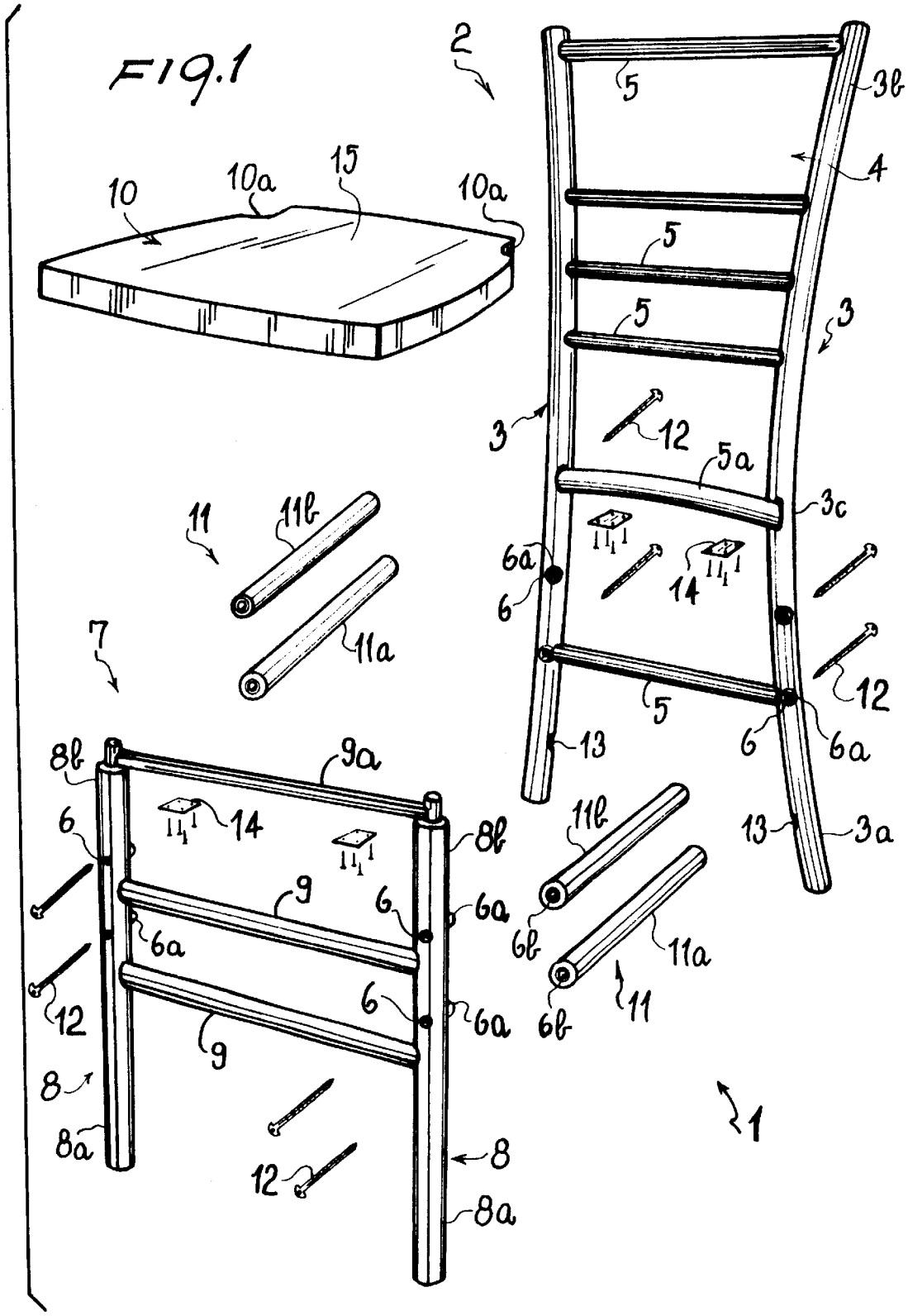
FIG. 1 is an exploded view of a chair in accordance with the invention.

With reference to the drawings, the chair adapted to be stacked in accordance with the invention is generally identified by reference numeral 1.

In a conventional and known manner, in accordance with the so-called "Chiavari style", it comprises a rear frame 2 formed of two rear uprights disposed spaced apart from each other in side by side relationship.

The rear uprights 3 have a slightly arched shape the concavities of which are turned outwardly of chair 1, so that both lower portions 3*a* and upper portions 3*b* of same tend to diverge from each other starting from intermediate portions 3*c* of the uprights 3 themselves.

The lower and upper portions 3*a* and 3*b* cooperate to define regions where the rear frame 2 embodies supports on the ground and a back 4, respectively. The rear uprights 3 are joined by a plurality of rear crosspieces 5, substantially perpendicular to the uprights themselves.

Some rear crosspieces 5 are disposed at the upper end portions 3*b* where they cooperate to form said back 4, possibly in association with vertical rod-like elements (not shown) which for instance are substantially vertical. Advantageously the whole rear frame 2 is of one piece construction and is made of plastic material.

In addition, chair 1 comprises a front frame 7 in turn comprising two front uprights 8 which too are spaced apart from each other in side by side relationship and extend between a lower portion 8*a* and an upper portion 8*b*.

The front uprights 8 too are connected with each other by front crosspieces 9, two front crosspieces 9 for example.

Advantageously the whole front frame 7 too, like the rear frame 2, is of one piece construction and is made of plastic material.

The lower portions 8*a* of the front uprights 8 are designed to define, together with the lower portions 3*a* of the rear uprights 3, four sections resting on the ground that are devoid of rear crosspieces 5 and front crosspieces 9.

A seat 10 is engaged at the rear with the intermediate portion 3*c* of the rear uprights 3 and at the front with the upper portion 8*b* of the front uprights 8. Seat 10 is provided, angularly and at the rear, with notches 10*a* adapted to enable passage of the rear uprights 3 of another chair of same structure in a stacked position.

Laterally, chair 1 comprises two pairs of lateral crossbars 11 for example, the function of which is of connecting frames 2 and 7 with each other. Each pair of lateral crossbars 11 on each side of chair 1 is formed of a lower crossbar 11*a* and an upper crossbar 11*b* rigidly connecting the rear uprights 3 to the front uprights 8.

The lateral crossbars 11 are substantially placed at the same height as the front crosspieces 9 and therefore the sections resting on the ground of the front uprights 8 and rear uprights 3 are devoid of said crossbars.

The lateral crossbars 11 are fastened by means of connecting elements that are particularly important for steadiness of chair 1 and a quick assembling of same, since frames 2 and 7 are each of one piece construction and are connected with each other only by the lateral crossbars 11 and seat 10.

These connecting elements are embodied both by restrained joints and by screws. The screws 12 are of the lag type passing through clearance holes 6 formed in the uprights 3 and 8 and coaxially engaging in the ends of the lateral crossbars 11.

The restrained joints are embodied by recesses 6*b* formed in the ends of the crossbars 11 and by tailpieces 6*a* projecting from the uprights 3 and 8 coaxially with the clearance holes 6. Tailpieces 6*a* are made of one piece construction with frames 2 and 7.

Each chair 1 of the above described type also comprises close-fit means adapted to removably engage the chair itself which is substantially snap fitted in a second underlying chair of same structure in the traditional and known stacked position.

The close-fit means uses the elasticity and also stability in time and under stress of the front and rear frames 2 and 7, each made of one piece construction and of plastic material.

In detail, provision is made for shaped close-fit regions to be snap engaged due to a substantially elastic deformation of the chair portions in which they are formed.

More specifically, the shaped close-fit regions are preferably formed in said sections resting on the ground of frames 2 and 7, which are elastically deformable because they are devoid of the crosspieces 5 and 9 and the lateral crossbars 11.

In the embodiment shown the shaped close-fit regions are only formed in the lower portions 3*a* of the rear uprights 3 of the rear frame 2. In addition, the same shaped close-fit regions are at the lateral crossbars 11, preferably at the upper crossbars 11*b*.

The technical solution shown in the figures is particularly simplified in order not to modify the traditional line of the concerned chairs and the shaped close-fit regions are distinguishable because they consist of simple notches 13 conforming in shape to the upper crossbars 11*b*.

Notches 13 are arranged in such a manner that they face each other and are turned inwardly of the chair, and consequently they are not very visible. In another aspect of the invention, the rear frame 2 and front frame 7 comprise a rear support element 5*a* and a front support element 9*a* respectively, which are adapted to support the seat 10 by close fitting.

In more detail: the rear support element 5*a* is placed at the intermediate section 3*c* of the rear uprights 3 and the front support element 9*a* is disposed at the upper portion 8*b* of the front uprights 8.

Close-fit engagement between the seat 10 and the rear 5*a* and front 9*a* support elements takes place by means of recessed seats formed in the lower face of the seat itself and consisting of a rear recessed seat 10*b* and a front recessed seat 10*c*.

Finally provision is made for stop plates 14 to be fastened astride the edges of the recessed seats 10*b* and 10*c* by means of screws adapted to lock the seat 10 to the transverse elements 5*a* and 9*a* inserted in said recessed seats.

Said seat 10 has an upper surface 15 adapted to receive a cushion, which may be merely put thereon or made rigid with the seat itself. Furthermore, the cushion too may be provided with means for close fit to the seat 10.

As pointed out, the whole chair 1 is made of plastic material and preferably it is made of a two-component polypropylene material, i.e. with an outer layer different from the core.

The outer layer for example consists of compact and glossy polypropylene, whereas the core consists of foamed and strong polypropylene. In this way a high resistance combined with an excellent aesthetic level is achieved.

Use of the chair is the following.

The lower portions 3*a* of the rear uprights 3 are devoid of the rear crosspieces 5 and the lateral crossbars 11 and consequently during the stacking operations they can be slightly spread apart by contact and forcing with the crossbars 11 of the underlying chair: they slide along the crossbars themselves until snap fitting of notches 13 takes place.

Said snap fitting is sufficient to make a stack of chairs steady, thus enabling both creation of stacks of large sizes in height and a quicker and safer manual transportation of the stacked chairs.

Figure 2:
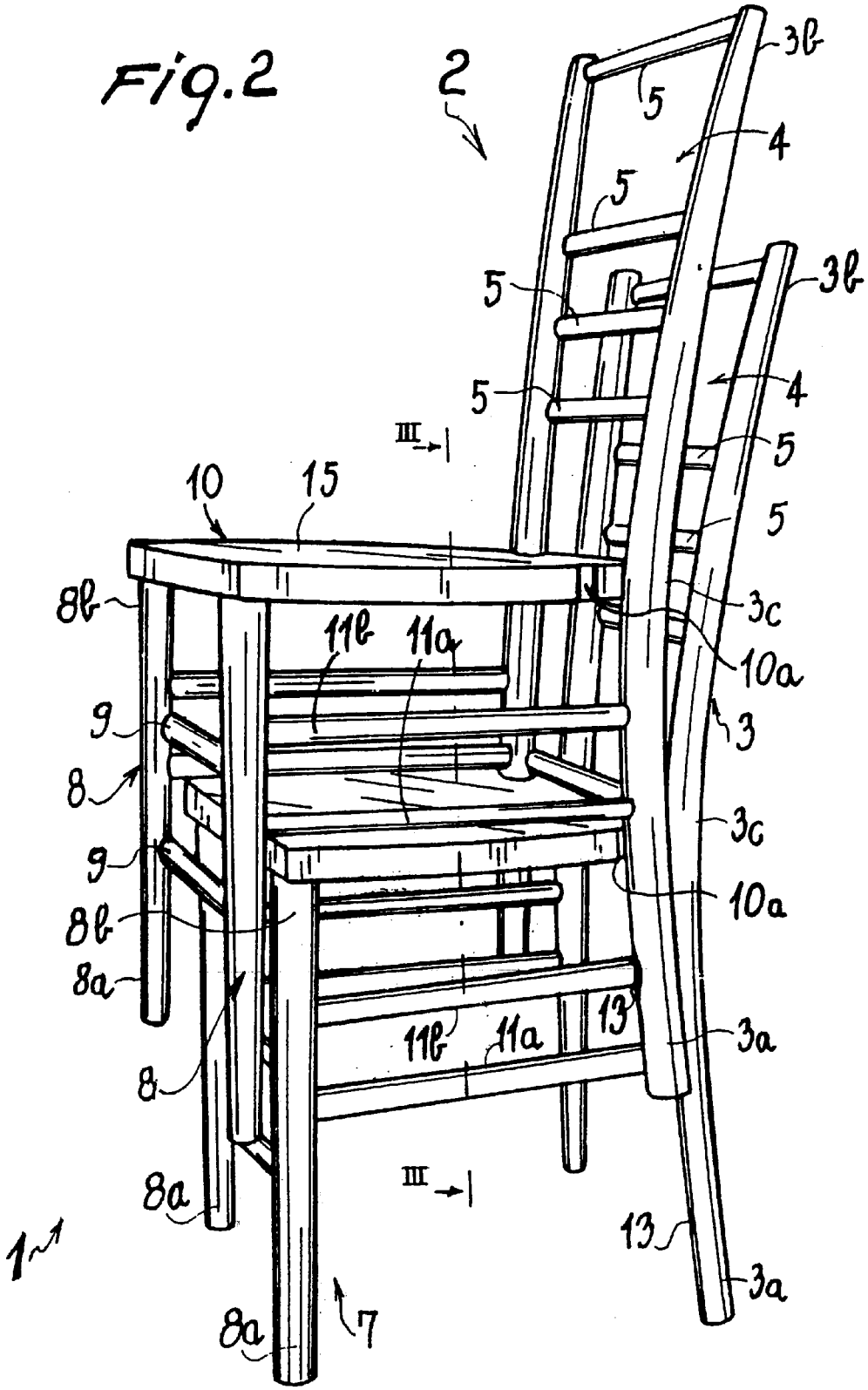
FIG. 2 is a perspective view of two chairs superposed on each other to form a stack.
Figure 3:
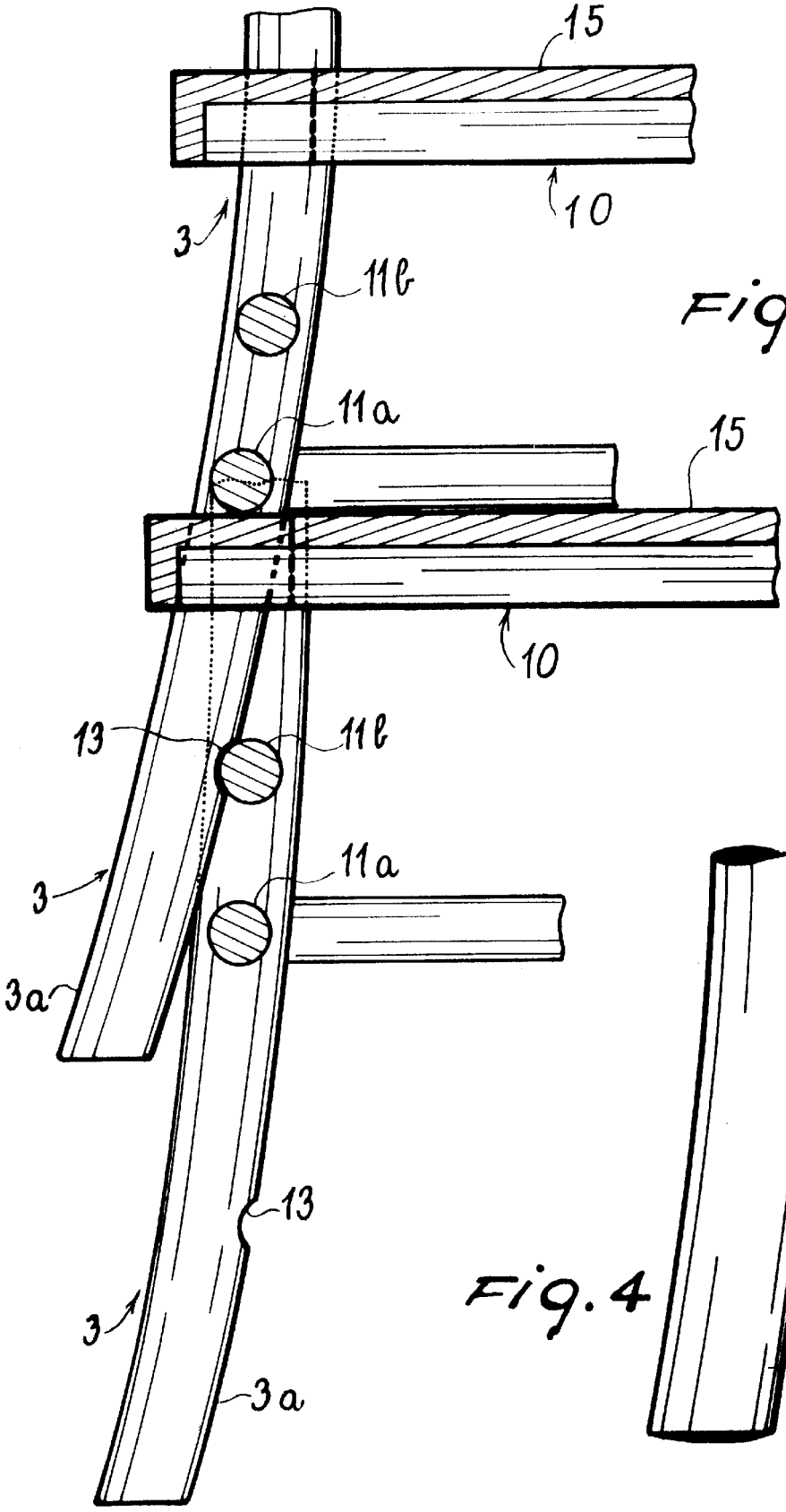
FIG. 3 is a partial section of two chairs superposed on each other, such a section being carried out along a vertical plane passing close to the rear uprights of the chairs themselves.
Figure 4:
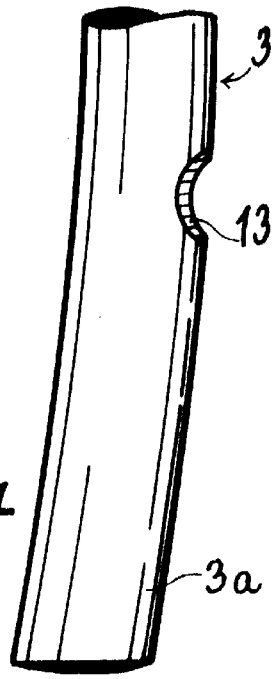
FIG. 4 is a perspective view of the close-fit means disposed on a rear upright of the chair.
Figure 5:
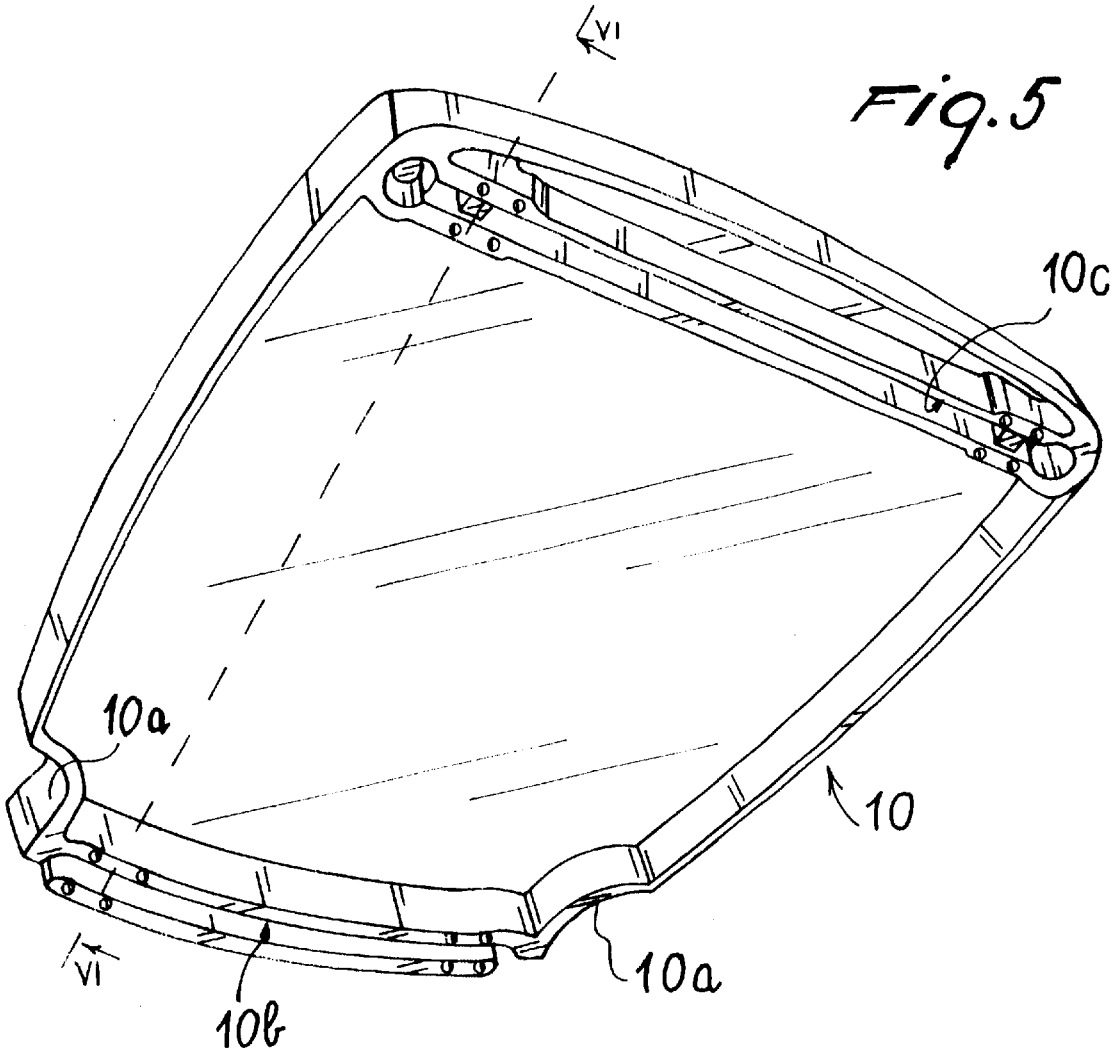
FIG. 5 is a bottom perspective view of the seat of the chair.
Figure 6:
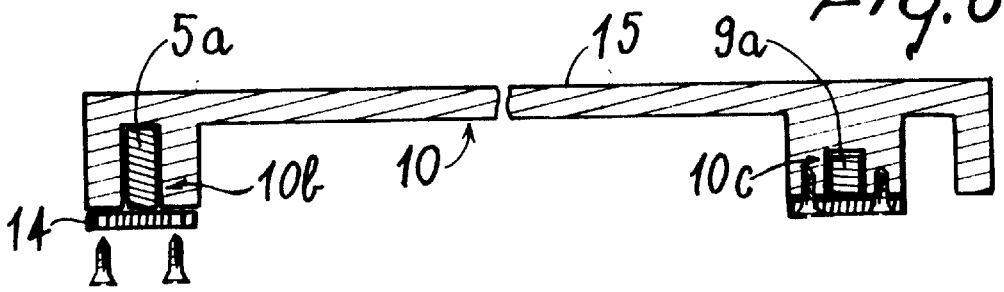
FIG. 6 is a section taken along line VI—VI in FIG. 5.

As shown in FIG. 2, the position of the lower lateral crossbars 11*a* relative to the upper surface of the seat 10 can be so chosen that the lateral crossbars 11*a* of a superposed chair rest on the seat 10 of an underlying chair.

It is also pointed out that the chair in accordance with the invention can be assembled or disassembled and transported over long distances with the greatest ease, reliability and cheapness.

In fact the chair has two main parts, the rear frame 2 and front frame 7, of one piece construction and substantially flattened so that they can be put close to each other, together with seat 10 and crossbars 11 in a disassembled position, which enables transportation of same without waste of room.

Assembling and disassembling are then very quick and simple, since the only required operations are application of seat 10 by close fitting, and of crossbars 11 by close fitting and screwing down.

The invention achieves important advantages.

The chairs as conceived enable formation of piles or stacks of great height which are also very steady, by a mere superposition of said chairs carried out following known and traditional modalities.

In addition, the snap fitting means provided in the chair in accordance with the invention do no modify the aesthetic appearance of the "Chiavari style" chair, while at the same time enabling increase in the number of chairs of this type to be stacked in a safe manner and without any risk of disarranging of the formed piles.

It will be also recognized that the snap fitting means on which the seat can be inserted and anchored greatly increases the overall solidity of the chair and in particular the resistance to loads to which the seat may be submitted. In fact, the seat and the rear and front frames, due to close fitting, form a block of the greatest resistance. In addition seat 10, due to its engagement by close fitting with the front frame and rear frame, can be replaced very easily.

The appearance and/or color of the seat can be modified in an immediate and simple manner and the seat may be either rigid or padded or upholstered and variously colored and decorated. This feature is important when said chairs are rented and it is necessary to adapt them each time to the features of the environment in which they are inserted.

What is claimed is:

1. A chair adapted to be stacked comprising: a rear frame (2) including two rear uprights (3) and rear crosspieces (5) connecting said rear uprights (3) with each other, a front frame (7) including two front uprights (8) and at least one front crosspiece (9) connecting said front uprights (8) with each other, said rear (3) and front (8) uprights having lower portions **(3*a*, 8*a*) defining sections designed to rest on the ground, and a seat (10) and lateral crossbars (11) connecting said rear uprights (3) to said front uprights (8), said chair comprising shaped close-fit regions (13) formed in at least one of said frames (2, 7) and adapted to accomplish a removable engagement, by close-fitting, with an underlying chair in a stacked position, said engagement involving forced and substantially elastic deformation of at least one said frames (2, 7) at said shaped close-fit regions (13)**.

2. A chair adapted to be stacked as claimed in claim 1, wherein said shaped close-fit regions (13) are embodied by notches.

3. A chair adapted to be stacked as claimed in claim 1, wherein said shaped close-fit regions (13) are arranged at said lower portions **(3*a*, 8*a*) of at least one of said frames (2, 7)**.

4. A chair adapted to be stacked as claimed in claim 1, wherein said shaped close-fit regions (13) consist of notches conforming in shape to the shape of said lateral crossbars (11) and arranged at said lower portions **(3*a*) of said rear uprights (3), whereby said lower portions (3*a*) can be forcedly spread apart and engaged substantially by snap fitting with said lateral crossbars (11)** of an underlying chair in a stacked position.

5. A chair adapted to be stacked as claimed in claim 1, wherein said rear (2) and front (7) frames each are of one piece construction and made of plastic material.

6. A chair adapted to be stacked as claimed in claim 5, wherein said lateral crossbars (11) are engaged with said rear (2) and front (7) frames by close fitting and screwing.

7. A chair adapted to be stacked as claimed in claim 5, wherein said rear (2) and front (7) frames are made of a two-component polypropylene material, of the type having an outer layer of glossy polypropylene and a core of foamed polypropylene.

8. A chair adapted to be stacked as claimed in claim 1, wherein said rear (2) and front (7) frames each comprise a rear support element **(5*a*) and a front support element (9*a*) to engage said seat (10)** by close fitting.

9. A chair adapted to be stacked as claimed in claim 8, wherein said seat (10) comprises a rear recessed seat **(10*b*) and a front recessed seat (10*c*) to house said rear support element (5*a*) and front support element (9*a*)** respectively, by close fitting.

10. A chair adapted to be stacked as claimed in claim 1, wherein in said stacked position lateral crossbars (11) of a superposed chair rest upon the seat (10) of an underlying chair.

* * * * *